US005571650A

United States Patent [19]

Hinch et al.

[11] Patent Number: 5,571,650

[45] Date of Patent: Nov. 5, 1996

[54] ORGANIC POSITIVE PHOTOCONDUCTOR

[75] Inventors: Garry D. Hinch, Louisville; Laura L. Kierstein, Westminster; Ronald H. Levin, Boulder, all of Colo.

[73] Assignee: Lexmark International, Inc., Greenwich, Conn.

[21] Appl. No.: 523,670

[22] Filed: Sep. 5, 1995

[51] Int. Cl.[6] ..... G03G 5/09

[52] U.S. Cl. ..... 430/83

[58] Field of Search ..... 430/59, 58, 83, 430/96

[56] References Cited

U.S. PATENT DOCUMENTS

| | | | |
|---|---|---|---|
| 3,357,989 | 12/1967 | Byrne et al. | 260/314.5 |
| 4,769,304 | 9/1988 | Kondo et al. | 430/56 |
| 5,128,226 | 7/1992 | Hung | 430/58 |

*Primary Examiner*—John Goodrow
*Attorney, Agent, or Firm*—John A. Brady

[57] ABSTRACT

A positive charging photoconductor of, preferably, 4 to 8 percent by weight metal-free phthalocyanine, 30–50 percent by weight tritolylamine and the remainder polyvinylbutyral.

4 Claims, No Drawings

ORGANIC POSITIVE PHOTOCONDUCTOR

DESCRIPTION

1. Technical Field

This invention relates to photoconductive elements for use in xerographic imaging and the like, and, specifically, to such elements which are both organic in composition and which operate well when charged to positive polarities.

2. Background of the Invention

Early organic photoconductors were constructed as a single layer, but soon thereafter the state of the art included the recognition that increased performance could be achieved by segregating the charge generation and charge transport functions into separate layers. Such bilayer elements have been the structure of choice for may years, but, if only for economic factors, the desirability of employing a single layer is generally recognized.

However, most of the currently available organic photoconductors charge only in a negative mode. Negatively charging systems for such elements generate ozone as an unwanted byproduct of the operation. Positive charging systems generate significantly less ozone and for that reason are preferred as inherently safe to the environment without the need for costly ozone filters. However, the fabrication of organic photoconductor elements which function by taking on a positive charge has proved difficult in practice.

Some attempts to create positive charging photoconductors continue to use a bilayer structure, but with the positions of the charge generating layer (CGL) and the charge transport layer (CTL) reversed (e.g., with the CGL on top). Such photoconductors can work in the positive mode, but continue to suffer from the inherent economic disadvantages of the bilayer system and further suffer from rapid wear of the exposed CGL layer and concomitant shod operating life of the photoconductor.

This invention employs metal-free phthalocyanine ($H_2$ PC) in a formulation of 1.0 organic materials which yields excellent results as a positive photoconductive element. The formulation is not known to have been used in any way as a photoconductive binder. Metal-free phthalocyanine is a long and widely known photoconductive material, as illustrated by U.S. Pat. No. 3,357,989 to Byrne et al.

The literature teaches that high dye loadings are desirable for effective photoconductor performance. However, loadings by weight of 20% metal-free phthalocyanine with 0 to 5% tritolyamine resulted in a high gamma response, high variability of electrostatic characteristics, between surface locations, and discharge behavior sensitive to both prior charge and light conditioning. At loadings of metal-free phthalocyanine by weight of 12% and tritolyamine still between 0 to 5%, the element was an insulator. Similarly, the reduction of metal-free phthalocyanine to 2% or less produces in an insulator.

DISCLOSURE OF THE INVENTION

This invention is a photoconductive element comprising, by weight, 4 to 12% metal-free phthalocyanine, 20% or more tritolyamine and the remainder polyvinylbutyral. Preferably this is dip coated on an anodized or otherwise roughened aluminum core.

BEST MODE FOR CARRYING OUT THE INVENTION

Standard, commercially available photoconductive grade metal-free phthalocyanine is employed, having a particle size which is at most about one micron in diameter. Coating is entirely conventional. The three ingredients, particulate phthalocyanine, tritolyamine and polyvinylbutyral are combined in a shaker (functionally a paint shaker) with 2 mm glass beads and tetrahydrofuran as a solvent. When the materials are thoroughly dispersed by the shaking, the dispersion is decanted into the tank of a dip coater, and a conventional anodized aluminum drum is dipped into the tank and withdrawn. The tetrahydrofuran is removed during an oven curing procedure, leaving a drum having a photoconductive outer layer. The velocity of withdrawal from the dip tank determines the thickness of that layer. A typical coat weight of the final photoconductor outer layer is typically in the range of 8–12 mg/in$^2$.

Tritolylamine is an amine with each tolyl moiety, bound directly to the central nitrogen. The structural formula is:

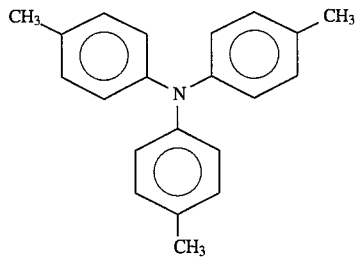

In the preferred formulations the tritolylamine content is 30 to 50% by weight, the phthalocyanine is 4–8% by weight, and the remainder is polyvinylbutyral.

Photoconductor drums having such coatings and charged positively from a +650 volt source exhibit very continuous discharge. Starting from more than 500 volts before exposure, the surface voltage decreases to less than 300 volts at a discharge energy of 0.5 microjoules per square centimeter, to about 200 volts at a discharge energy of 1 microjoule per square centimeter, to about 175 volts at a discharge energy of 1.5 microjoules per square centimeter, to about 160 volts at a discharge energy of 2 microjoules per square centimeter. This was a smooth response (no avalanche behavior) with a high initial slope, which is desirable.

Dark decay (the tendency to lose charge in the dark) is entirely satisfactory and largely invariate over the foregoing ranges of ingredients and at coating thicknesses varying by factors of more than 2. Charge and discharge values vary little as the tritolylamine content varies from 30 to 50% by weight. Although, these values tend to decrease when the phthalocyanine is increased from 4 to 8% by weight, the development vector remains substantially constant.

Overall characteristics for performance as a positive photoconductor appear excellent. Accordingly, this invention achieves a single-layer, positive-chargeable organic photoconductor. Since the specific formulas given may be varied by those skilled in the art, the scope of this invention should be as provided by law, with particular reference to the accompanying claims.

What is claimed is:

1. A photoconductive element capable of retaining a positive electrical charge sufficient for xerographic imaging comprising by weight 4 to 12% metal-free phthalocyanine, at least 20% tritolylamine and the remainder polyvinylbutyral.

2. The photoconductive element of claim 1 in which said phthalocyanine is 4 to 8% by weight, and said tritolylamine is 30 to 50% by weight.

3. The photoconductive element of claim 2 in which said element consists of said phthalocyanine, said tritolylamine and said polyvinylbutyral.

4. The photoconductive element of claim 1 in which said element consists of said phthalocyanine, said tritolylamine and said polyvinylbutyral.

* * * * *

UNITED STATES PATENT AND TRADEMARK OFFICE
CERTIFICATE OF CORRECTION

PATENT NO. : 5,571,650

DATED : November 5, 1996

INVENTOR(S) : Hinch et al.

It is certified that error appears in the above-identified patent and that said Letters Patent is hereby corrected as shown below:

Col. 1, Line 34 -- Change "shod" to read -- short --.

Col. 1, Line 37 -- Delete "1.0" --.

Signed and Sealed this

Nineteenth Day of August, 1997

*Attest:*

*Attesting Officer*

BRUCE LEHMAN

*Commissioner of Patents and Trademarks*